US006830040B1

(12) United States Patent
Toyoda

(10) Patent No.: US 6,830,040 B1
(45) Date of Patent: Dec. 14, 2004

(54) EVAPORATIVE FUEL CONTROL SYSTEM OF INTERNAL COMBUSTION ENGINE

(75) Inventor: Katsuhiko Toyoda, Hamamatsu (JP)

(73) Assignee: Suzuki Motor Corporation, Hamamatsu (JP)

( * ) Notice: Subject to any disclaimer, the term of this patent is extended or adjusted under 35 U.S.C. 154(b) by 0 days.

(21) Appl. No.: 10/709,891

(22) Filed: Jun. 4, 2004

(30) Foreign Application Priority Data

Jun. 4, 2003 (JP) ..... 2003-159188

(51) Int. Cl.[7] ..... F02M 33/10
(52) U.S. Cl. ..... 123/520; 123/519
(58) Field of Search ..... 123/520, 519, 123/518, 521

(56) References Cited

U.S. PATENT DOCUMENTS

| | | | |
|---|---|---|---|
| 5,111,796 | A | 5/1992 | Ogita |
| 5,237,979 | A | 8/1993 | Hyodo et al. |
| 5,251,592 | A | 10/1993 | Seki et al. |
| 5,425,344 | A | 6/1995 | Otsuka et al. |
| 5,499,617 | A | 3/1996 | Kitajima et al. |
| 5,647,333 | A | 7/1997 | Mukai |
| 5,778,865 | A | 7/1998 | Tachibana et al. |
| 5,850,820 | A | 12/1998 | Tsutsumi et al. |
| 5,862,795 | A | 1/1999 | Osanai |
| 5,918,581 | A | 7/1999 | Uto et al. |
| 2002/0069861 | A1 | 6/2002 | Sakamoto |

FOREIGN PATENT DOCUMENTS

| | | |
|---|---|---|
| EP | 0818621 A1 | 1/1998 |
| EP | 0896143 A2 | 2/1999 |
| JP | H11-343925 | 12/1999 |
| JP | B-3106645 | 9/2000 |
| JP | A-2000-282972 | 10/2000 |
| JP | B-3139095 | 12/2000 |
| JP | B-3139096 | 12/2000 |
| JP | B-3139188 | 12/2000 |

*Primary Examiner*—Bibhu Mohanty
(74) *Attorney, Agent, or Firm*—Matthias Scholl

(57) ABSTRACT

This invention provides an evaporative fuel control system for an internal combustion engine which system comprises an intake passage and a canister in communication with a fuel tank. The canister includes more than one chamber with activated carbon provided to absorb evaporative fuel. In this system, the canister is connected to the atmosphere via an open passage which is controlled by the atmosphere open/close valve situated in the open passage. The canister is also connected to the intake passage via a purge passage. The purge passage is controlled via a purge valve situated in the purge passage. The evaporative fuel control system comprises further a purge concentration detector which detects the concentration of a purge taken into the engine and a controller which diagnoses leakage after a predetermined amount of time set according to the concentration of the purge detected by the purge concentration detector.

12 Claims, 8 Drawing Sheets

EVAPORATIVE FUEL CONTROL SYSTEM OF INTERNAL COMBUSTION ENGINE

CROSS REFERENCE TO RELATED APPLICATIONS

Pursuant to 35 U.S.C. §119 and the Paris Convention Treaty, this application claims the benefit of Japanese Patent Application No. 2003-159188, filed on Jun. 4, 2003, and incorporated herein by reference.

BACKGROUND OF INVENTION

1. Field of the Invention

This invention relates to evaporative fuel control system of an internal combustion engine, and more particularly to an evaporative fuel control system designed to avoid degradation in exhaust gas purification performance during the detection of possible evaporative fuel control system failure.

2. Description of Related Art

Traditional designs of internal combustion engines permit for unwanted air pollution and loss of fuel due to evaporation of fuel from the tank, the carburetor, and other engine components. To obviate these problems, modern automotive vehicles typically include evaporative fuel controllers (also known as evaporative fuel control systems, evaporative emission control systems, or simply EECSs), which generally employ fuel vapor collection canisters containing an adsorbent material, such as activated carbon, for adsorbing evaporative fuel, and a purge system for releasing the adsorbed fuel and supplying it to the engine at certain times conducive to such purging.

Because EECSs rely on pressure variations to desorb the evaporative fuel adsorbed by activated carbon and to forward it to the combustion chamber of the engine, if a failure of EECS occurs, e.g., when the EECS is compromised due to a physical damage, such as a crack or hole, or due to detachment of the fuel tank cap, evaporated fuel may be emitted into the ambient atmosphere in amounts greater than if these systems were not at all present in automotive vehicles. Thus, is important to provide for a built-in detection system and methods designed to diagnose evaporative fuel control system failure whenever EECSs are used.

Evaporative fuel control system failure detection devices have been described in the literature, for example, by Tadahiro (JP Laid-Open No. H11-343925) and Shingo, et al., (JP Laid-Open No. 2000-282972). Moreover, methods for diagnosing failure of evaporative purge systems (EPSs) utilizing negative pressure in the intake pipe have been disclosed in Japanese Patents Nos. 3139095, 3139096, 3106645, and 3139188, which are owned by the assignee of this invention.

However, EECS failure detection devices described in the literature suffer from a variety of operating problems. Specifically, a change in physical conditions, such as movement of fuel in the fuel tank, temperature rise as a result of engine operation, and variations in atmospheric pressure, can affect the vapor pressure in the fuel tank and thereby degrade the precision of failure diagnosis. In addition, because EFCS failure detection devices are designed to stop checking for failure under these circumstances, if a failure coincides with the change of physical conditions failure is not timely detected resulting in prolonged air pollution and loss of fuel.

To detect a failure of EECSs, it is preferable to apply negative pressure to the system and to determine whether it holds. However, if negative pressure is applied to the evaporative fuel control system so as to check for failure under conditions wherein the EECSs are operating normally and while much evaporative fuel resides in the evaporative system, the fuel-air mixture that is drawn into the engine becomes undesirably rich thereby resulting in incomplete combustion, rough engine operation and poor emissions. Thus there is an urgent need for EECSs and methods capable of detecting their own failure, wherein the diagnosis of failure is suspended at times when much evaporative fuel resides in the EECS detection passage.

SUMMARY OF INVENTION

The invention described herein provides an evaporative fuel control system for an internal combustion engine which system comprises an intake passage and a canister in communication with a fuel tank. The canister includes more than one chamber with an adsorbent material, such as activated carbon, provided to absorb evaporative fuel. In this system, the canister is connected to the atmosphere via an open passage which is controlled by the atmosphere open/close valve situated in the atmosphere open passage. The canister is also connected to the intake passage via a purge passage. The purge passage is controlled via a purge valve situated in the purge passage. The evaporative fuel control system comprises further a purge concentration detector which detects the concentration of a purge taken into the engine and a controller which diagnoses leakage after a predetermined amount of time calculated according to the concentration of the purge detected by the purge concentration detector. The diagnosis of leakage is not performed when a high concentration of evaporative fuel resides in the passage utilized for leak diagnosis. Thus, this evaporative fuel control system and methods avoid the detrimental effect of leak detection on the exhaust gas purification performance.

In certain embodiments, this invention is directed to an evaporative fuel control system for an internal combustion engine comprising: an intake passage; a canister disposed in an evaporative fuel control passage in communication with a fuel tank to absorb the evaporative fuel; an open passage to the atmosphere to communicate said canister with the atmosphere; an atmosphere open/close valve disposed in said atmosphere open passage; a purge valve disposed between said intake passage and said canister; a detector of the concentration of purge which purge is taken into said engine; and a controller for performing a diagnosis of failure of the evaporative fuel control system after a predetermined purge time has elapsed, said purge time being set according to the concentration of the purge detected by said detector.

In certain preferred embodiments, the predetermined purge time is set to be longer the higher the concentration of the purge. In a class of these embodiments the predetermined purge time is calculated according to the formula Tpurge=$m_1$*(Purge Concentration)+a, wherein $m_1$ is a number between 0 and 50; and a is a number between −500 and 500. In a subclass of this class, $m_1$ is a number between 0 and 0.5, a is a number between 0 and 10, for purge concentrations lower or equal to 33.3%; $m_1$ is a number between 0.4 and 5 and a is a number between −100 and −50, for purge concentrations higher than 33.3% but lower or equal to 50.0%; $m_1$ is a number between 4 and 15 and a is a number between −400 and −300, for purge concentrations higher than 50.0% but lower or equal to 66.6%; and $m_1$ is a number between 0 and 0.5, and a is a number between 150 and 250, and particularly about 180, for purge concentrations higher than 66.6%,.

In certain other preferred embodiments, the controller performs the diagnosis of failure while the atmosphere open/close valve is closed and the purge valve has been opened for a predetermined diagnosis time T1.

In certain other preferred embodiments, the controller prevents updating of the purge concentration value while the failure diagnosis is performed.

In certain other preferred embodiments, the predetermined diagnosis time T1 is set based on a temperature of the fuel system and/or a value of the atmospheric pressure.

In certain other preferred embodiments, the controller is capable of diagnosing failure due to a large leak within the evaporative fuel control system, such as a large leak resultant from a detachment of a fuel tank cap.

In certain other preferred embodiments, the controller performs the diagnosis of failure of the evaporative fuel control system only when the detector detects the purge concentration which is lower than 10%.

In other aspects, the invention is directed to methods of diagnosing failure of the evaporative fuel control system by executing the following steps: (a) waiting for the predetermined purge timeTpurge to elapse; (b) measuring the inner tank pressure GPT1 while the purge valve is closed and the atmosphere open/close valve is open; (c) closing the atmosphere open/close valve; (d) opening the purge valve; (e) measuring the inner fuel tank pressure PT while the purge valve is open and the atmosphere open/close valve is closed; and (f) comparing said pressure measured in step (b) to said pressure measured in step (e). In certain preferred embodiments, the failure of the evaporative fuel control system is positively diagnosed when the difference between the pressure measured in step (a) and the pressure measured in step (d) is lower than a predetermined reference value GPTL at the time when a predetermined diagnosis time T1 has elapsed.

BRIEF DESCRIPTION OF DRAWINGS

FIG. 6(*a*) illustrates the relationship between temperatures of fuel/evaporative fuel control system and Tevp (in sec.), and FIG. 6(*b*) illustrates the relationship between atmospheric pressure (in kPa) and Tpa (in sec).

FIG. 9(*a*) is a time chart showing the opening angle of the purge valve (in %, wherein 0% represents a fully closed purge value and 100% represents a fully open purge valve), FIG. 9(*b*) is a time chart illustrating updating of the purge concentration (in %), FIG. 9(*c*) is a time chart showing the physical state of the atmosphere valve (showing whether open or closed), FIG. 9(*d*) is a time chart illustrating the totalized failure diagnosis time T1 (in sec.), FIG. 9(*e*) is time chart illustrating the purge time Tpurge (in sec.), FIG. 9(*f*) is a time chart illustrating internal pressure in the intake manifold (in kPa), and FIG. 9(*g*) is a time chart illustrating internal pressure PT in the fuel tank (in kPa).

FIG. 10(*a*) is a time chart illustrating the opening angle of the purge valve (in %, wherein 0% represents a fully closed purge value and 100% represents a fully open purge valve), FIG. 10(*b*) is a time chart illustrating updating of the purge concentration, FIG. 10(*c*) is a time chart showing the physical state of the atmosphere valve (showing whether open or closed), FIG. 10(*d*) is a time chart illustrating the totalized failure diagnosis time T1 (in sec.), FIG. 10(*e*) is time chart illustrating the purge time Tpurge (in sec.), FIG. 10(*f*) is a time chart illustrating internal pressure in the intake manifold (in kPa), and FIG. 10(*g*) is a time chart illustrating the internal pressure PT in the fuel tank (in kPa).

FIG. 11(*a*) is a time chart illustrating the opening angle of the purge valve (in %, wherein 0% represents a fully closed purge value and 100% represents a fully open purge valve), FIG. 11(*b*) is a time chart illustrating the engine speed (in rpm), FIG. 11(*c*) is a time chart illustrating fuel correction value based on the purge concentration (in %), FIG. 11(*d*) is a time chart showing the physical state of the atmosphere valve (showing whether open or closed), and FIG. 11(*e*) is a time chart illustrating the inner tank pressure PT (in kPa).

FIG. 12(*a*) is a time chart illustrating the opening angle of the purge valve (in %, wherein 0% represents a fully closed purge value and 100% represents a fully open purge valve), FIG. 12(*b*) is a time chart illustrating engine speed (in rpm), FIG. 12(*c*) is a time chart illustrating fuel correction value based on the purge concentration (in %), FIG. 12(*d*) is a time chart showing the physical state of the atmosphere valve (showing whether open or closed), and FIG. 12(*e*) is a time chart illustrating the inner tank pressurePT (in kPa).

DETAILED DESCRIPTION

The invention disclosed herein will be described more fully hereinafter with reference to the accompanying drawings, in which preferred embodiments of the invention are shown. This invention may, however, be embodied in many different forms and should not be construed as limited to the embodiments set forth herein, rather, these embodiments are provided so that this disclosure will be thorough and complete, and will fully convey the scope of the invention to those skilled in the art. Like numbers refer to like elements throughout.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed herein and that modifications and other embodiments are intended to be included within the scope of the appended claims. Although specific terms are employed herein, they are used in a generic and descriptive sense only and not for purposes of limitation.

Architecture

Figure 3:
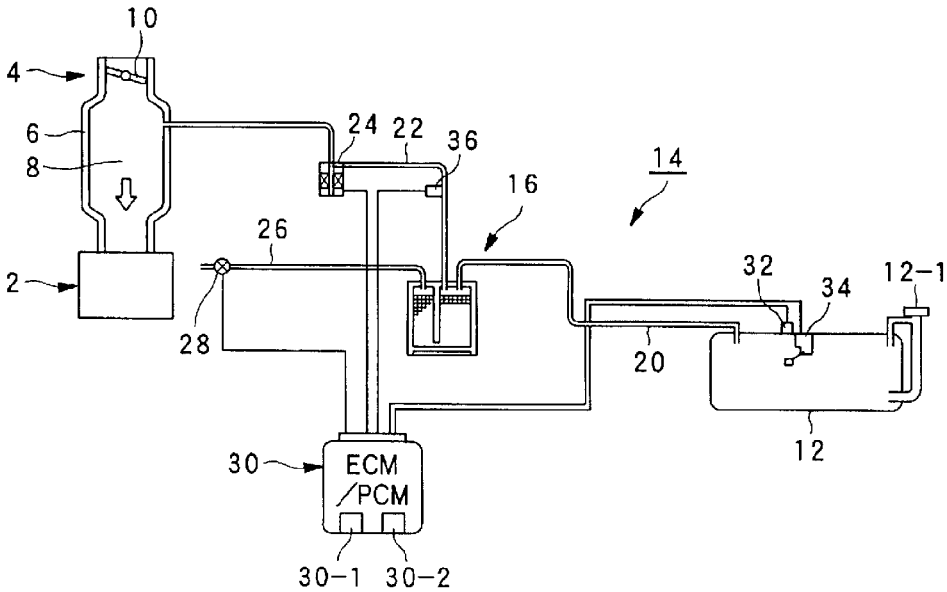
FIG. 3 is a schematic diagram of the evaporative fuel control system.

The architecture of an evaporative fuel control system of this invention will now be described in more detail. FIG. 3 is a schematic diagram showing an internal combustion engine 2 (also referred to as "engine"), having one or more combustion chambers (not shown); an intake pipe 4, comprised of a surge tank 6, an intake passage (also referred to as intake manifold) 8, and a throttle valve 10; a fuel tank 12, having a fuel tank cap 12-1; and an evaporative fuel control system 14. Within the evaporative fuel control system 14, an evaporative fuel control passage 16 connects the fuel tank 12 to the surge tank 6 downstream (i.e., on the side of the surge tank located closer to the engine combustion chamber) of the throttle valve 10. A canister 18 is located in the evaporative fuel control passage 16 so as to adsorb the evaporative fuel. The evaporative fuel control passage 16 is further comprised of an evaporation passage 20 which connects the fuel tank 12 and the canister 18, and a purge passage 22 which connects the canister 18 and the surge tank 6. The canister 18 includes more than one chamber containing an adsorbent material, such as activated carbon. Within the purge passage 22, a purge valve 24 is situated to regulate the amount of evaporative fuel purged from the canister 18 and supplied to the intake passage 8. The canister 18 is further connected to one end of an atmosphere open passage 26. The other end of the atmosphere open passage 26 connects to the ambient atmosphere via an atmosphere open/close valve 28.

The purge valve 24 and the atmosphere open/close valve 28 are connected to a controller (e.g, a microprocessor-based engine management computer, ECM, or power control module, PCM) 30. Controller 30 is also connected to an inner pressure sensor 32, a fuel level sensor 34, and a purge concentration detector 36. More particularly, the inner pressure sensor 32 is attached to the fuel tank 12 to detect the inner pressure within the fuel tank 12. The fuel level sensor 34 is situated in the fuel tank 12 to detect the fuel level in the fuel tank 12. The purge concentration detector 36 is situated within the purge passage 22, and more particularly between the canister 18 and the purge valve 24, to detect the concentration of fuel in the purge gas taken into the internal combustion engine 2 (purge concentration).

The controller 30 detects EECS failure of the evaporative system as defined by the boundaries of the fuel tank 12, the purge valve 24, and the atmosphere valve 28, by means of the negative pressure of the engine 2. Specifically, the controller 30 includes a failure detecting section 30-1 for detection of an abnormal condition (e.g., large leakage of evaporative fuel), and a timer 30-2.

Operation

EECS failure diagnosis performed while much evaporative fuel resides within the evaporative fuel control passage (i.e., when the concentration of evaporative fuel in the evaporative fuel control passage exceeds about 30%) results in incomplete combustion, rough engine operation and poor emissions. Thus, the controller 30 is configured to perform EECS failure diagnosis only after a purge has been carried out for a predetermined timeTpurge, which is calculated according to the purge concentration measured by the detector 36. Purge concentration refers to the concentration of vaporized fuel within the air fuel mixture purged into the intake passage 8 during purge cycles.

Figure 7:
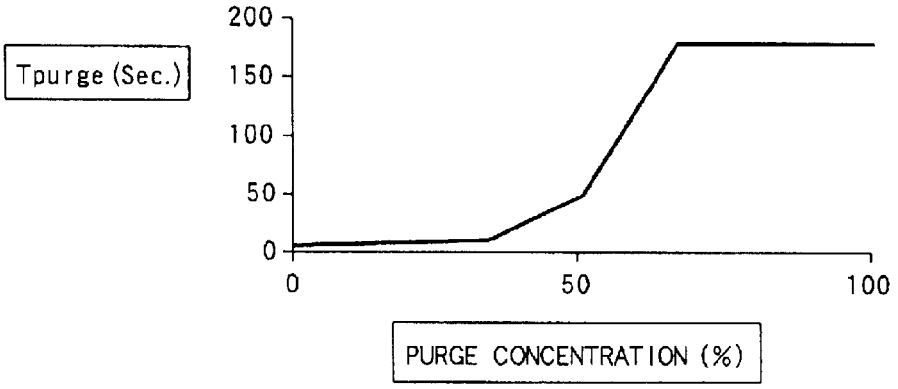
FIG. 7 is a diagram showing the relationship between the purge time Tpurge (in sec.) and the purge concentration (in %

The predetermined timeTpurge is greater the higher the concentration of the purge. That is, the time of purge becomes longer the higher the concentration of the fuel in the purge, and the time of purge becomes shorter the lower the concentration of the fuel in the purge. The predetermined purge time Tpurge is set based on the purge concentration as shown in FIG. 7. Specifically, the totalized purge time Tpurge (in sec.) is calculated according to the formula Tpurge=$m_1$*(Purge Concentration)+a, wherein $m_1$is a number between 0 and 50 and a is a number between −500 and 500. For purge concentrations lower or equal to 33.3%, $m_1$ is particularly between 0 and 0.5 and a is a number between 0 and 50, and more particularly a is a number between 0 and 10; for purge concentrations higher than 33.3% but lower or equal to 50.0%, $m_1$ is particularly between 0.4 and 5 and a is a number between −100 and −20, and more particularly a is a number between −100 and −50; for purge concentrations higher than 50.0% but lower or equal to 66.6%, $m_1$ is particularly between 4 and 15 and a is a number between −500 and −200, and more particularly a is a number between −400 and −300; and for purge concentrations higher than 66.6%, $m_1$ is particularly between 0 and 0.5, and a is particularly between 150 and 250, and more particularly about 180.

The success of the diagnosis of failure is predicated upon the proper operation of the atmosphere open/close valve 28. Thus, before completing EECS failure diagnosis the proper operation of the atmosphere open/close valve is checked according to the following procedure. The inner tank pressure PT (kPa) is measured by the inner pressure sensor 32 while the purge valve 24 is closed (at an opening angle of 0%; purge-off) and while the atmosphere open/close valve 28 is open. This measured pressure is referred to as the inner tank pressure GPT1 (purge-off). At this time, because the atmosphere open/close valve is set to open, the pressure in the evaporative system is supposed to equal to that of the atmosphere, except if the atmosphere open/close valve 28 is in failure. Therefore, it is determined that the atmosphere open/close valve 28 is in failure if the inner tank pressure GPT1 (purge-off) is higher than a certain high pressure threshold PThigh for determination of failure of the atmosphere valve 28, or is lower than a certain low pressure threshold PTlow for determination of failure of the atmosphere valve 28. Specifically, in certain embodiments of this invention, PThigh is a pressure between about 90 kPa and about 120 kPa and PT-low is a pressure between about 50 kPa and about 110 kPa.

If it is determined that the atmosphere valve 28 is not in failure, then the atmosphere valve 28 is closed and the purge valve 24 is opened. After the purge valve 24 has been opened for a predetermined amount of time Ti, the controller 30 performs additional steps in the diagnosis of failure.

Since during the diagnosis of EECS failure the concentration of purge is different from that present during normal system operation, during EECS failure diagnosis the controller 30 prevents the purge concentration value stored in the controller from being updated. This is to say that during certain parts of the EECS failure diagnosis, the controller 30 does not register new values of purge concentration as measured by the purge concentration detector in the controller's memory for the purpose of EECS failure diagnosis. After the diagnosis of a normal condition, i.e., the absence of failure, however, the controller restarts updating the purge concentration with the last value stored in the memory.

In certain embodiments of this invention, the diagnosis of EECS failure is based on comparison of the inner tank pressure PT (in kPa), the inner tank pressure GPT1 during the purge-off (in kPa) and a reference value GPTL within the diagnosis time Ti. In certain embodiments of this invention, the reference value GPTL is a number between −0.4 and −0.9 kPa, more particularly between −0.5 and −0.8 kPa and most particularly about −0.7 kPa≈−5 mmHg. Specifically, it is determined that the evaporative system is in the normal condition if a difference between the inner tank pressure PT (kPa) of the closed evaporative system and the inner tank pressure GPT1 during purge-off is greater than or equal to a reference value GPTL within the diagnosis time T1. Thus, it is determined that the evaporative system is in the normal operating condition if the equation (GPT1−PT)≧GPTL is satisfied. Conversely, it is determined that the EECS is in failure if within the diagnosis time T1 the equation (GPT1−PT)≧GPTL is not satisfied.

In certain other embodiments of this invention, the normal operating condition, i.e., the lack of failure, may be determined by comparing the tank inner pressure PT directly to the reference value GPTL. Specifically, normal operating condition is present when the tank inner pressure PT is greater or equal to the reference value GPTL within the diagnosis time T1, or when the equation PT≧GPTL is satisfied. Conversely, EECS failure is present when the tank inner pressure PT is lower than reference value GPTL within the diagnosis time T1, or when the equation PT≧GPTL is not satisfied.

Following the diagnosis of normal operating conditions (as opposed to EECS failure) within the diagnosis time T1, the purge valve 24 is returned to its open position for ordinary EECS operation.

During the diagnosis of failure it may become of importance that at higher operating temperatures, higher operating altitudes and at lower atmospheric pressures, more fuel vapors are generated in the fuel tank 12 than at lower operating temperatures, lower operating altitudes and higher barometric pressures. Specifically, under the former conditions the high pressure of evaporated fuel in the EECS may adversely affect the diagnosis of failure of the EECS and may result in a false positive failure determination. Accordingly, certain embodiments of this invention provide for initial setting of the diagnosis time T1 based on the temperature of the fuel system and/or the atmospheric pressure. Specifically, in certain embodiments of this invention, the diagnosis time T1 is initially calculated from the equation: T1=Tevp+Tpa. That is to say that the diagnosis time T1 is initially calculated only based on Tevp and Tpa. However, when purge concentrations are higher at the time of failure determination, the time T1 is extended by the controller (i.e., totalized) until the high purge concentrations subside.

Figure 6:
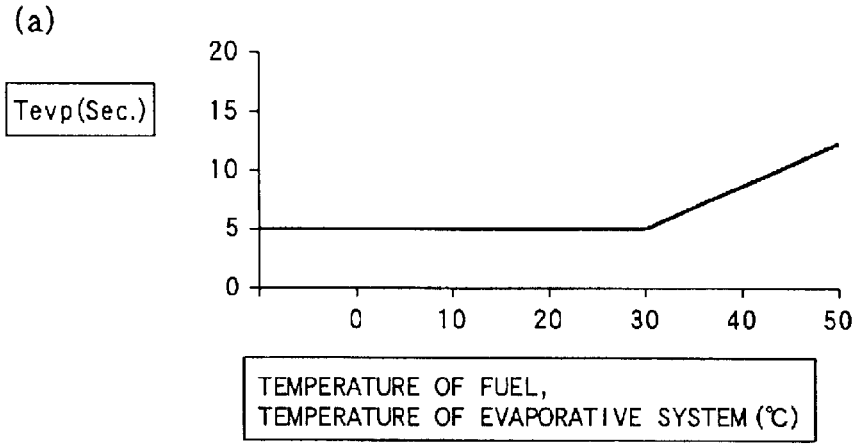
FIG. 6 illustrates the dependency of the initial components Tevp and Tpa of the failure diagnosis time T1 on the temperature of fuel and the atmospheric pressure, respectively.
Figure 6:
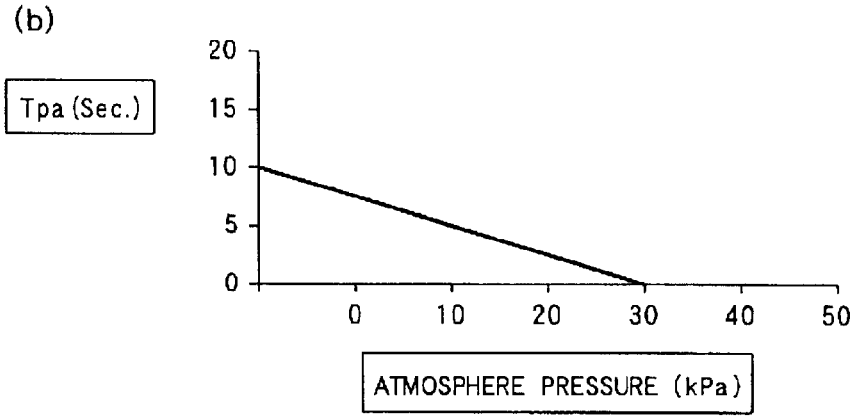

As shown in FIG. 6(*a*), time Tevp (sec.) is determined based on the fuel temperature (fuel system temperature) and/or the evaporative system temperature. In certain embodiments, the fuel temperature and the evaporative system temperature are measured directly by temperature sensors placed in the fuel tank and within the evaporative emission control system, respectively. In other embodiments, fuel temperature and the evaporative system temperature are determined indirectly from appropriate data value tables, e.g., tables relating the fuel temperature and/or the evaporative system temperature to other physical characteristics of the system.

Specifically, Tevp=$m_2$*(Temperature of fuel)+b, wherein at temperatures lower than 30° C., $m_2$=0 and b is an amount of time between 0 and 20 seconds, more particularly between 1 and 10 seconds, and most particularly about 5 sec.; and wherein at temperatures greater or equal to 30° C., $m_2$ is a number between 0 and 5, more particularly between 0.05 and 2, and most particularly about 0.375, and b is a number between −20 and 20, more particularly between −10 and 10, and most particularly about −6.25.

The "temperature of fuel" in the above equation for the determination of Tevp represents the actual fuel temperature in the fuel tank, as measured by a temperature sensor, or as determined from other physical characteristics of the system; or it represents the temperature of the evaporative emission system, as measured by a temperature sensor, or as determined from other physical characteristics of the system; or it represents a combination of the actual fuel temperature in the fuel tank and the temperature of the evaporative emission system, e.g, as their average, simple, weighted, or otherwise; or it represents any other value directly or indirectly related to the actual fuel temperature in the fuel tank or the temperature of the evaporative emission control system, or to both.

As shown in FIG. 6(*b*), time Tpa (in sec.) is determined based on the atmospheric pressure (in kPa). Specifically, Tpa=$m_3$*(Atmospheric pressure)+b, wherein $m_3$ is a number between −5 and −0.01, more particularly between −0.5 and −0.01, and most particularly about −0.111, and b is a number between 0 and 20, more particularly between 5 and 15, and most particularly about 10.

Figure 4:
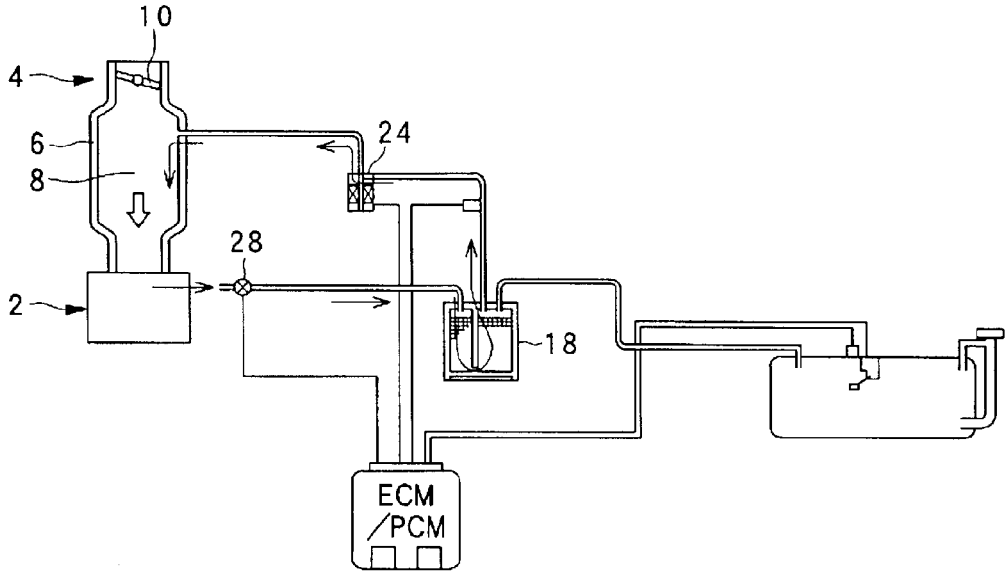
FIG. 4 is a schematic diagram showing a flow of purge through the evaporative fuel control system in a normal condition.
Figure 5:
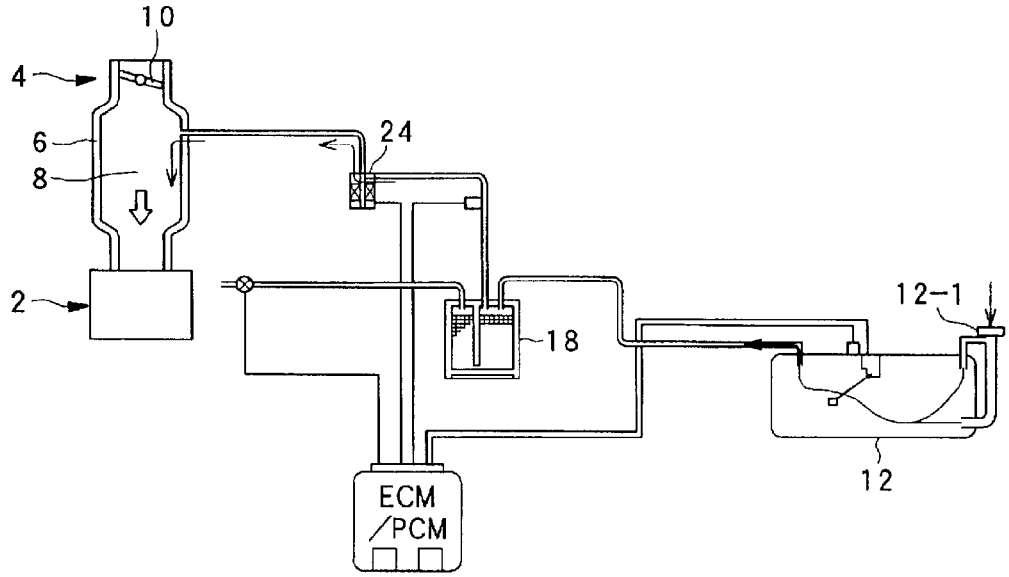
FIG. 5 is a schematic diagram showing a flow of purge through the evaporative fuel control system in an abnormal condition in which the fuel tank cap is detached.
Figure 8:
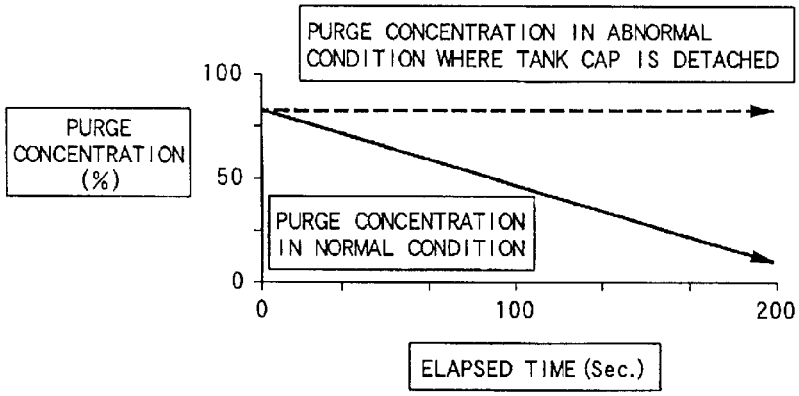
FIG. 8 is a diagram illustrating the purge concentration (in %) as a function of elapsed time (in sec.) under normal condition (solid line) and under abnormal condition, e.g., where there is a large leak, e.g., due to the fuel tank cap being detached (dashed line).
Figure 9:
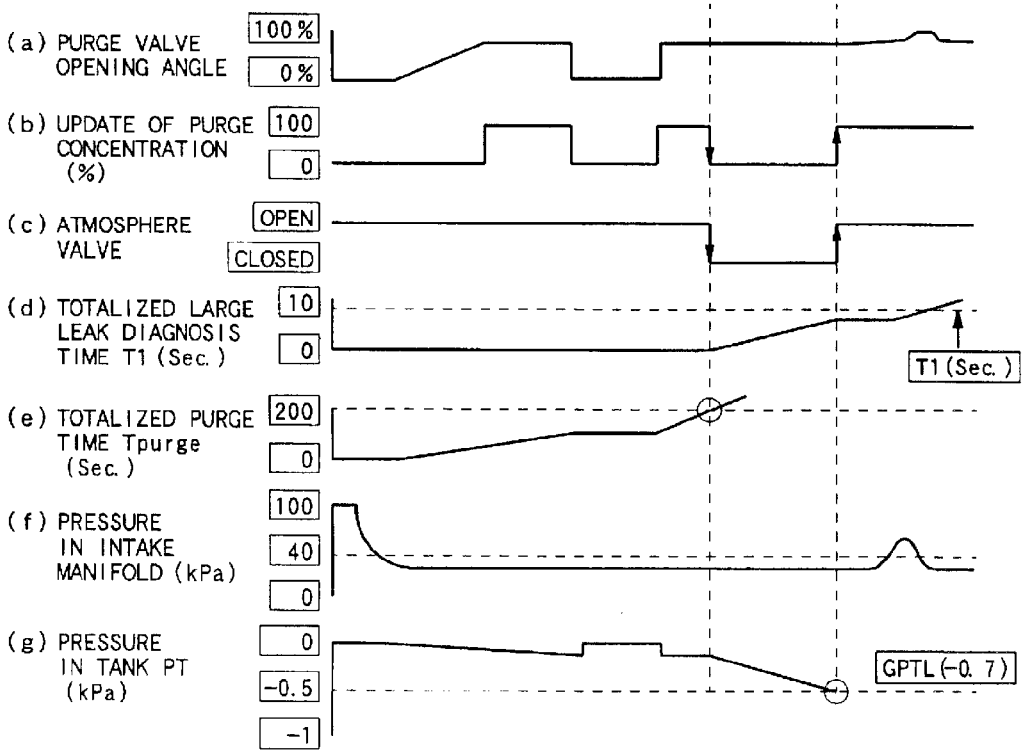
FIG. 9 is a diagram showing physical characteristics relating to the evaporative control system under a normal condition, where there is no large leak in the evaporative system.
Figure 10:
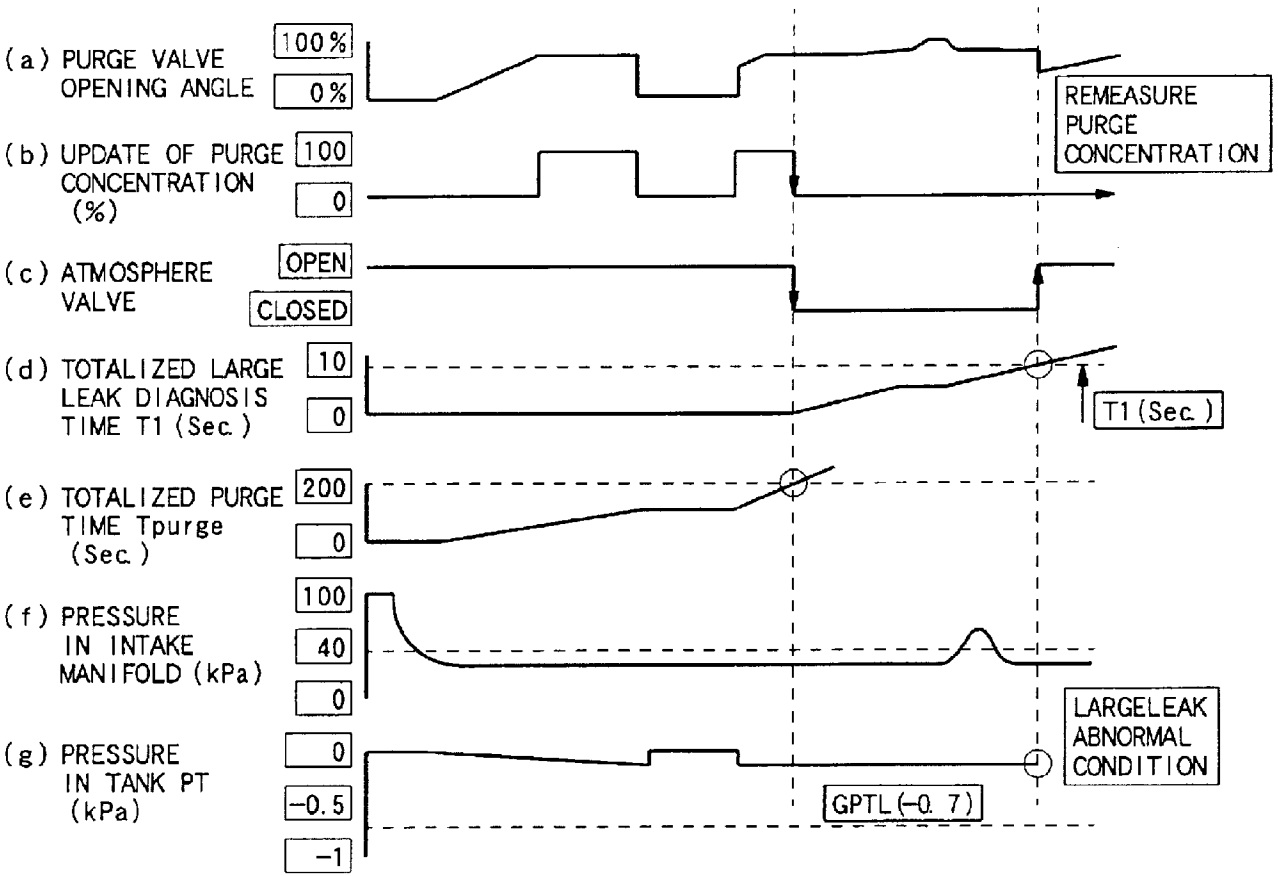
FIG. 10 is a diagram showing physical characteristics relating to the evaporative control system in an abnormal condition, where a large leak is present in the evaporative system.

Under normal conditions where no leak occurs in the evaporative system, as shown in FIG. 4, the ambient air drawn through the atmosphere open/close valve 28 passes through the cylinder 18 where it picks up desorbed fuel continuing through the purge valve 24 to the intake passage 8 of the engine. The concentration of fuel in the purge decreases with time as evaporated fuel is drawn into the engine. This is illustrated by the solid purge concentration line in FIG. 8. However, if the fuel tank cap 12-1 is detached, a condition shown in FIG. 5, the ambient air is additionally drawn through the fuel tank opening created by the absence of the fuel tank cap. Accordingly, under these conditions, the concentration of the fuel in the purge does not decrease with time, as shown by the dashed line in FIG. 8, because the ambient air passing through the fuel tank continuously picks up new fuel vapors and carries them through cylinder 18 and the purge valve 24 to the intake passage 8 of the engine. When the fuel tank cap is replaced the abnormal condition illustrated in FIG. 5 reverts to the normal condition shown in FIG. 4 and the amount of fuel vapors generated in the fuel tank decreases rapidly.

Figure 11:
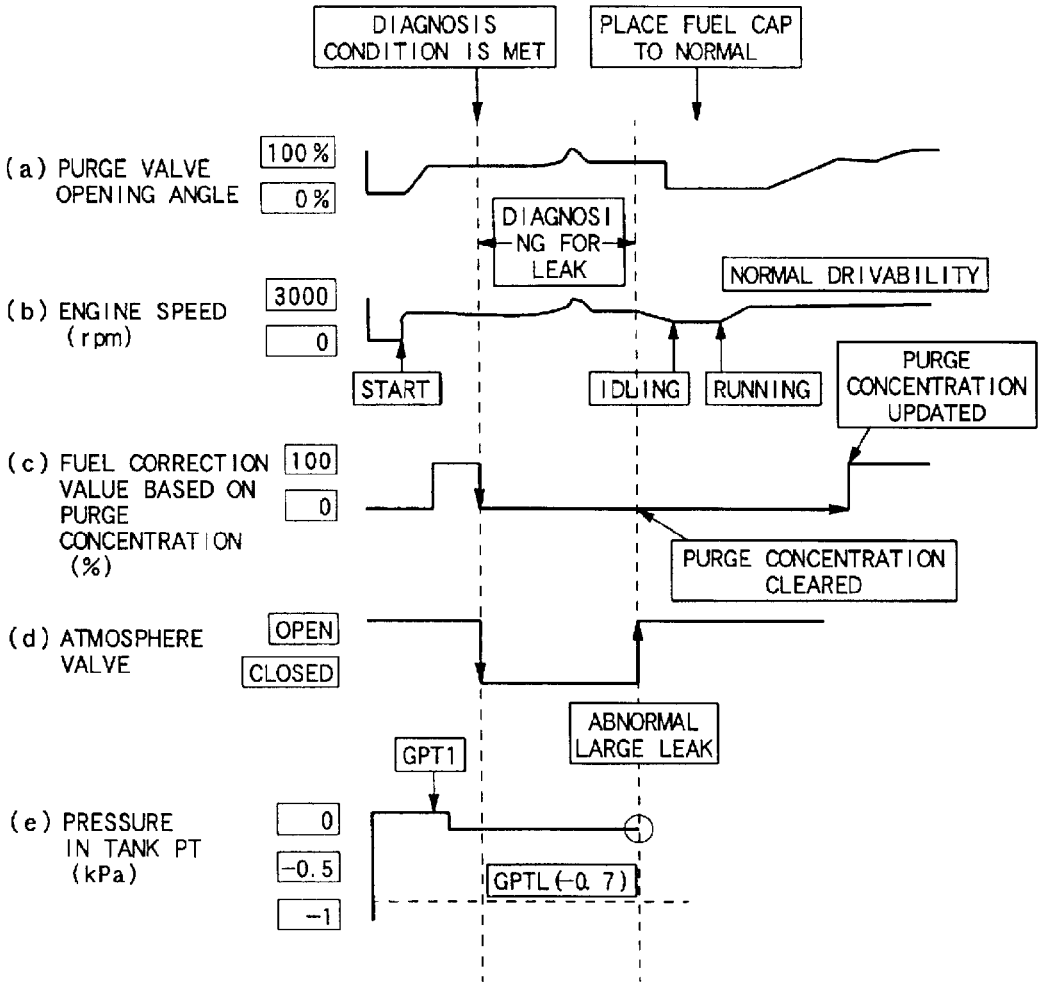
FIG. 11 is a diagram illustrating physical characteristics relating to the evaporative control system before, during, and after recovery from an abnormal condition to the normal condition.
Figure 12:
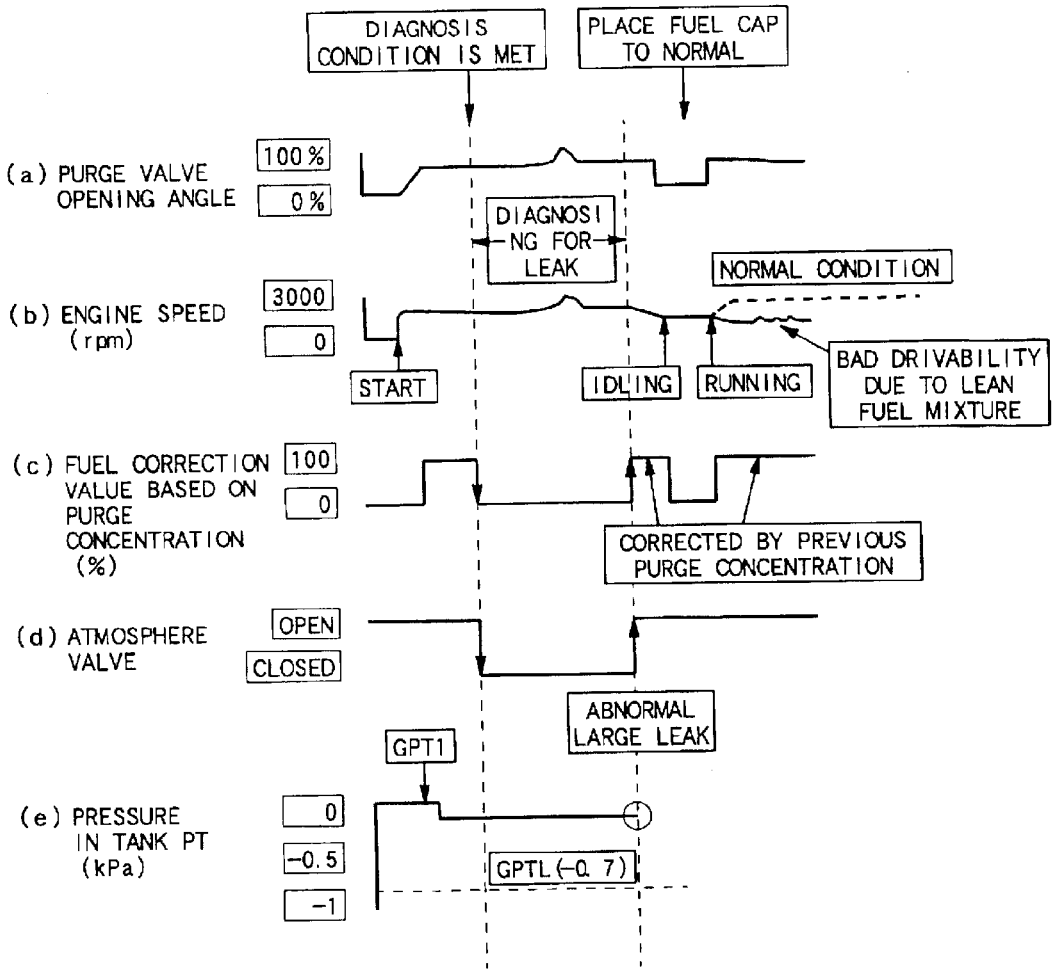
FIG.12 PRIOR ART
FIG. 12 is a diagram illustrating physical characteristics relating to the evaporative control system of prior art before, during, and after recovery from an abnormal condition to a normal condition.

EECSs described in the literature suffer from the following problem: at the instant the EECS is restored from failure to a normal operating condition (e.g., when a fuel tank cap is replaced), the fuel supplied to the engine is corrected based still on the previously measured purge concentration, which was necessarily large due to existing failure. However, because the EECS failure is no longer present at that time, the content of fuel in the fuel air mixture is overcorrected and becomes lean, which results in bad drivability due to engine speed decrease or engine stall, as shown in FIG. 12. To obviate this problem, certain embodiments of this invention provide for clearing of the previously measured purge concentration from the memory and for remeasuring it during the detection of EECS failure (step 128, FIG. 1). This procedure corrects the problems of lean fuel to air mixture and results in normal drivability, as illustrated in FIG. 11.

Figure 1:
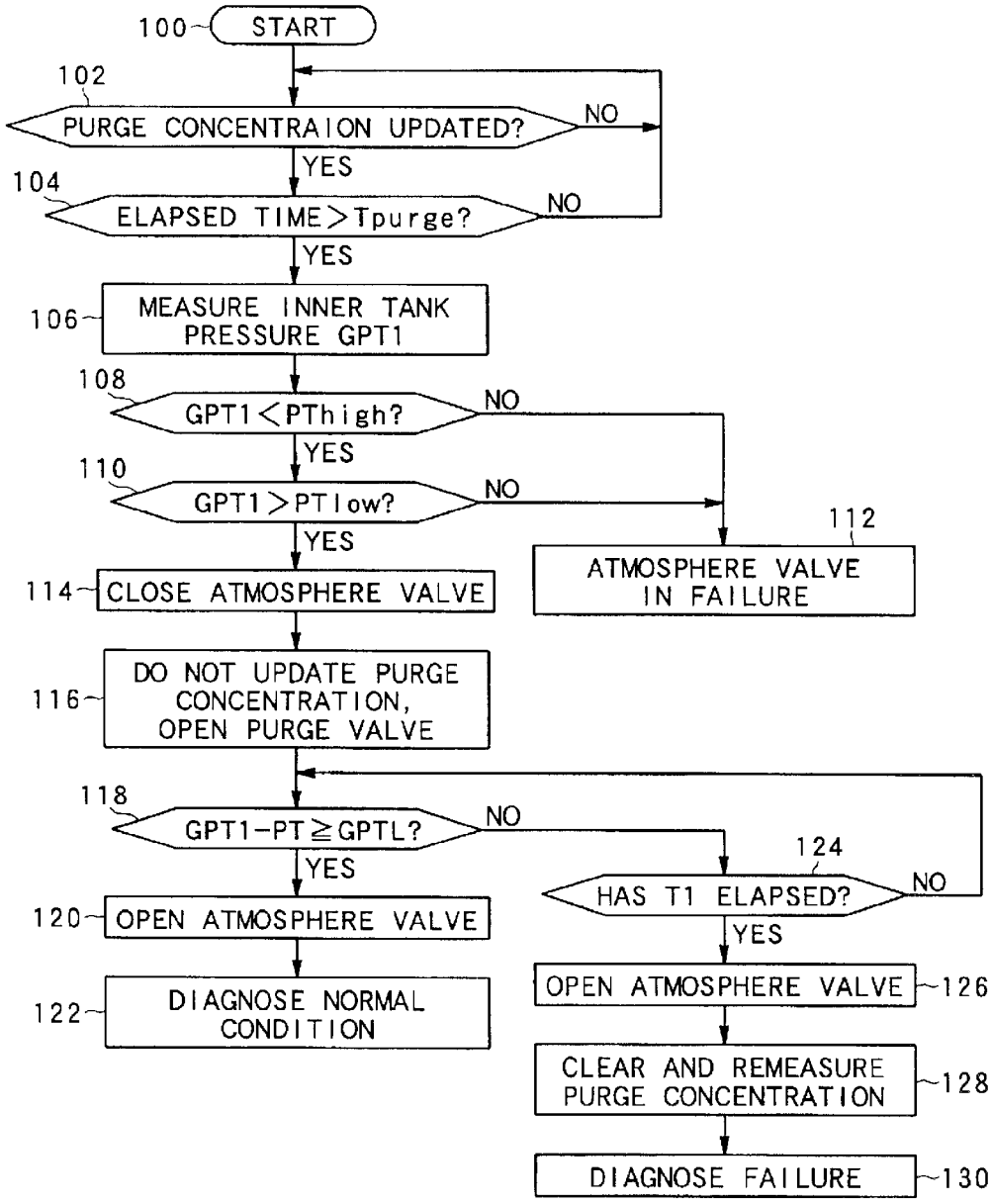
FIG. 1 is a flowchart illustrating operation of the evaporative fuel control system of an internal combustion engine of this invention.

Referring to FIG. 1, the program for control of the evaporative fuel control system 14 will now be described in detail. The control program starts in step 100. A determination is made in step 102 whether the purge concentration measured by the purge concentration detector 36 has been updated, i.e., the program waits for a new purge concentration measurement data to arrive at the controller 30. If this is not the case, step 102 is repeated. If, however, the purge concentration has been updated, a determination is made in step 104 whether the elapsed time since the purge has started exceeds the purge time Tpurge. If this is not the case, steps 102 and 104 are repeated. If the elapsed time since the purge has started exceeds the purge time Tpurge, however, the tank inner pressure GPT1 is measured while the purge is not performed, i.e., while the purge valve 24 is shut off, and while the atmosphere open/close valve 28 is open. Then the determination is made in step 108 whether the tank inner pressure GPT1 is less than the threshold PThigh. If this is not the case then the atmosphere open/close valve 28 has likely failed (step 112), as the pressure in an open to atmosphere system would not likely exceed the value of PTHigh. If, however the tank inner pressure GPT1 is less than the threshold PThigh, then while the purge valve 24 is still shut off and the atmosphere open/close valve 28 is still open, a determination is made in step 110 whether the tank inner pressure GPT1 is greater than the threshold PTlow. If this is not the case then the atmosphere open/close valve 28 has likely failed (step 112), as the pressure in an open to atmosphere system would not likely be below the value of PTlow. If GPT1 is greater than the low threshold PTlow, the atmosphere open/close valve 28 is closed in step 114, and while the controller 30 prevents the purge concentration from being updated, the purge valve 24 is opened in step 116. Following the purge valve opening, a determination is made in step 118 whether the difference between the inner tank pressure PT of the closed evaporative system and the inner tank pressure GPT1 recorded during purge-off is greater than or equal to a reference value GPTL within the diagnosis time T1. This is represented by the equation: $(GPT1-PT) \geqq GPTL$. If this is the case, then the atmosphere open/close valve 28 is opened in step 120, and it is determined in step 122 that the EECS is in a normal condition. If, however, the equation: $(GPT1-PT) \geqq GPTL$ is not satisfied, then a determination is made in step 124 whether the diagnosis time T1 has elapsed. If the diagnosis time T1 has not elapsed then the program returns to step 118. If, however, the diagnosis time T1 has elapsed then the atmosphere open/close valve 28 is opened in step 126. The concentration of purge is cleared and remeasured in step 128, and it is determined that the system is in failure in step 130.

Figure 2:
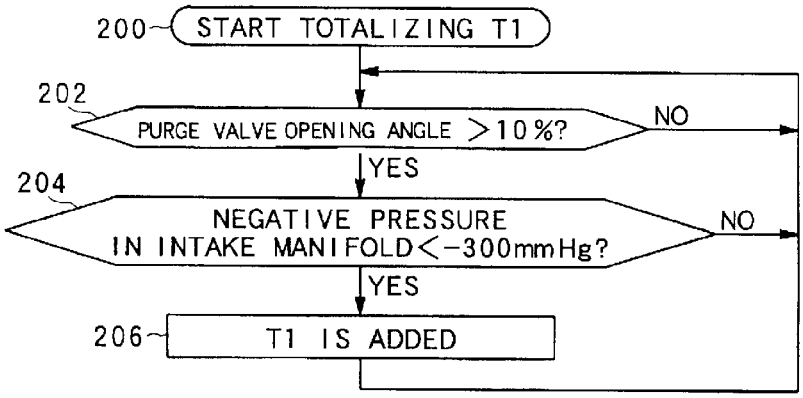
FIG. 2 is a flowchart illustrating a procedure for totalizing of failure diagnosis time T1.

Referring to FIG. 2, the control program for totalizing the large leak diagnosis time T1 will now be described in more detail. The control program for starts in step 200. A determination is made in step 202 whether the purge concentration is grater than 10%. If this is not the case then the failure diagnosis time T1 is not totalized and the program repeats step 202. If, however, the purge concentration exceeds 10% then a determination is made in step 204 whether the negative pressure in the intake manifold is lower than 300 mmHg. If the negative pressure in the intake manifold is not less than −300 mmHg then the program returns to step 202. If, however, the negative pressure in the intake manifold is less than −300 mmHg, then T1 is totalized is step 206 and the program returns to step 202. This is to say that the T1 time is continuously extended by the controller until such time when the purge concentration is less than or equal to 10% and the negative pressure in the intake manifold is greater than or equal to −300 mmHg. Thus, the controller 30 performs failure diagnosis after the predetermined time T1 set according to the concentration of the purge detected by the purge concentration detector 36, and the diagnosis for the leakage is not performed when much evaporative fuel resides in the passage for failure diagnosis. This avoids affection to the exhaust gas purification performance during the detection of possible failure.

Also, the predetermined time Tpurge is set according to the purge concentration detected by the purge concentration detector 36. The predetermined time is set to be longer as the concentration of the purge becomes higher. That is, the controller 30 waits for a longer amount of time before starting failure diagnosis so that the high purge concentrations may subside. This avoids the degradation in exhaust gas purification performance during the detection of possible evaporative fuel control system failure.

In summary, some of the advantages of the various embodiments of this invention are as follows. Because the controller 30 performs failure diagnosis while the atmosphere open/close valve 28 is closed and the purge valve 24 is opened for the predetermined diagnosis time T1, the need for an additional sensor or control system is eliminated. In addition, the controller 30 prevents updating of the purge concentration value during failure diagnosis because the concentration of the purge during diagnosis of failure is different from that under normal EECS operation. This avoids the problem of bad drivability after an abnormal condition is diagnosed. Also the diagnosis time T1 is initially set based on the temperature of the fuel system or the atmospheric pressure, which parameters affects the amount of the evaporative fuel generated within the system. This greatly improves the precision of the failure diagnosis and is advantageous in practical use.

This invention is not to be limited to the specific embodiments disclosed herein and modifications for various applications and other embodiments are intended to be included within the scope of the appended claims. For example, in the aforementioned embodiments, the function to determine the abnormal condition (large leakage due to e.g., puncture, corrosion, loss of seal, etc.) is included within the EECS control flow. However, an abnormal condition, such as that presented when the fuel tank cap is detached may be detected within the realm of another system. More particularly, in certain embodiments of this invention, a detector is placed directly in communication with the fuel tank cap and when the fuel tank cap is removed the detector, having detected the removal, communicates said removal by causing a visual signal to be displayed and/or an audio signal (e.g., buzzer) to be rung inside the vehicle. Thereby, the detachment of the cap from the fuel tank can be easily detected with reliability, which is advantageous in practical use. In yet other embodiments, this invention provides for a detector disposed at various pipe junctions of the evaporative passage or the purge passage so as to monitor for abnormal leakage condition and to attribute the abnormal condition to poor pipe connections. Therefore, while this invention has been described in connection with particular examples thereof, the true scope of the invention should not be so limited since other modifications will become apparent to the skilled practitioner upon a study of the drawings, specification, and following claims.

What is claimed is:

1. An evaporative fuel control system for an internal combustion engine comprising:

(a) an intake passage;

(b) a canister for absorbing evaporative fuel disposed in an evaporative fuel control passage in communication with a fuel tank;

(c) an open passage to the atmosphere to communicate said canister with the ambient atmosphere;

(d) an atmosphere open/close valve disposed in said atmosphere open passage;

(e) a purge valve disposed between said intake passage and said canister;

(f) a detector of the concentration of purge which purge is taken into said engine; and (g) a controller for performing a diagnosis of failure of the evaporative fuel control system after a predetermined purge time has elapsed, said purge time being set according to the concentration of the purge detected by said detector.

2. The evaporative fuel control system of claim 1, wherein said predetermined purge time is set to be longer the higher the concentration of the purge.

3. The evaporative fuel control system of claim 1, wherein said controller performs parts of the diagnosis of failure while said atmosphere open/close valve is closed and after said purge valve has been opened for a predetermined diagnosis time.

4. The evaporative fuel control system of claim 1, wherein said controller prevents updating of the purge concentration value while said failure diagnosis is performed.

5. The evaporative fuel control system of claim 3, wherein said predetermined diagnosis time is set based on a temperature of fuel within the evaporative fuel control system and/or a value of the atmospheric pressure.

6. The evaporative fuel control system of claim 1, wherein said controller is capable of diagnosing failure due to a large leak within the evaporative fuel control system.

7. The evaporative fuel control system of claim 6, wherein said large leak results from a detachment of a fuel tank cap.

8. The evaporative fuel control system of claim 1, wherein said controller performs said diagnosis of failure only when said detector detects the purge concentration which is lower than 10%.

9. The evaporative fuel control system of claim 2, wherein said predetermined purge time is calculated according to the formula $Tpurge=m_1*(\text{Purge Concentration})+a$, wherein $m_1$ is a number between 0 and 50; and a is a number between −500 and 500.

10. The evaporative fuel control system of claim 9, wherein for purge concentrations lower or equal to 33.3%, $m_1$ is a number between 0 and 0.5, a is a number between 0 and 10;

for purge concentrations higher than 33.3% but lower or equal to 50.0%, $m_1$ is a number between 0.4 and 5 and a is a number between −100 and −50;

for purge concentrations higher than 50.0% but lower or equal to 66.6%, $m_1$ is a number between 4 and 15 and a is a number between −400 and −300; and for purge concentrations higher than 66.6%, $m_1$ is a number between 0 and 0.5, and a is a number between 150 and 250.

11. A method of diagnosing a failure in an evaporative fuel control system of claim 1, said method comprising the steps of:

(a) waiting for said predetermined purge time to elapse;

(b) measuring a pressure within said inner tank while said purge valve is closed and said atmosphere open/close valve is open;

(c) closing said atmosphere open/close valve;

(d) opening said purge valve;

(e) measuring a pressure within said inner tank-while said purge valve is open and said atmosphere open/close valve is closed; and (f) comparing said pressure measured in step (b) to said pressure measured in step (e).

12. The method of claim 10, wherein said failure is positively diagnosed when the difference between said pressure measured in step (a) and said pressure measured in step (d) is lower than a predetermined reference value when a predetermined diagnosis time has elapsed.

* * * * *

UNITED STATES PATENT AND TRADEMARK OFFICE

CERTIFICATE OF CORRECTION

PATENT NO. : 6,830,040 B1
DATED : December 14, 2004
INVENTOR(S) : Katsuhiko Toyoda It is certified that error appears in the above-identified patent and that said Letters Patent is hereby corrected as shown below:

Column 1,
Line 61, delete “EFCS” and insert -- EECS -- therefor;

Column 3,
Line 21, delete “time Tpurge” and insert -- time Tpurge -- therefor;
Line 59, delete “%” therefor;

Column 4,
Line 55, delete “pressurePT” and insert -- pressure PT- -- therefor;

Column 6,
Lines 4 and 9, delete “timeTpurge” and insert -- time Tpurge -- therefor;
Line 54, delete “PT-low” and insert -- Ptlow -- therefor;
Line 59, delete “Ti” and insert -- T1 -- therefor, Column 7,
Line 10, delete “Ti” and insert -- T1 -- therefor, Column 8,
Lines 6 and 8, delete “C.,” and insert -- C, -- therefor, Column 9,
Line 66, delete “300 mmHg” and insert -- -300 mmHg -- therefor, Column 12,
Line 32, delete “tank-while” and insert -- tank while -- therefor.

Signed and Sealed this

Twenty-sixth Day of April, 2005

JON W. DUDAS
*Director of the United States Patent and Trademark Office*